United States Patent [19]

Olson

[11] 4,109,988

[45] Aug. 29, 1978

[54] DUPLEX OUTLET DEVICE

[76] Inventor: Ernest E. Olson, 911 S. Owen, Mount Prospect, Ill. 60056

[21] Appl. No.: 815,937

[22] Filed: Jul. 15, 1977

[51] Int. Cl.[2] ..... H01R 13/59; H01R 33/04

[52] U.S. Cl. ..... 339/91 R; 339/147 R; 339/154 A

[58] Field of Search ..... 339/91 R, 10, 32 R, 339/33, 147 R, 147 P, 153, 154 A; 219/267

[56] References Cited

U.S. PATENT DOCUMENTS 4,054,352 10/1977 Rudin ..... 339/91 R X

*Primary Examiner*—Roy Lake
*Assistant Examiner*—E. F. Desmond
*Attorney, Agent, or Firm*—Wegner, Stellman, McCord, Wiles & Wood

[57] ABSTRACT

A duplex outlet device for use in an automotive vehicle having a cigarette lighter device defined by a cup-shaped socket. The outlet device includes a plug portion adapted to be received in the lighter socket and defines a pair of outer sockets each of which is provided with a pair of electrical contacts. One of the outer sockets may receive the cigarette lighter plug portion and the other of the sockets may receive an auxiliary plug to provide electrical power to auxiliary equipment, such as a CB radio of the vehicle. The outlet device may further include an antenna connector which may be removably carried by the portion of the outlet device defining the socket. The electrical circuit leading to the contact of the second socket may be connected in series with a suitable fuse and manually operable switch, as desired. The device may further include a manually operable locking device for effectively positively securing the device plug portion in the vehicle lighter socket.

9 Claims, 7 Drawing Figures

DUPLEX OUTLET DEVICE

BACKGROUND OF THE INVENTION

1. Field of the Invention

This invention relates to automotive vehicle devices and in particular to electrical control devices for use therein.

2. Description of the Prior Art

In the conventional automotive vehicle, a cigarette lighter may be provided, as in the dashboard thereof. The cigarette lighter conventionally includes a socket portion mounted in the dashboard and a plug portion which is removably received in the socket portion and which carries a heating element which is heated to a high temperature for igniting a cigarette or the like when the plug element is suitably depressed within the socket. Thus, the socket includes a pair of contacts for electrically energizing the plug portion when so depressed. The contacts are connected to the vehicle power supply which conventionally includes a director and battery.

It has been conventional to utilize the cigarette lighter socket as a means for connecting auxiliary devices. Thus, as shown in U.S. Pat. No. 2,812,423 of James Penna, a vehicle warning light is provided with a cord having a connector at the distal end adapted to be received in the socket of the cigarette lighter of the automobile. The warning light is provided with an outlet socket and a trouble light is shown having a connector adapted to be removably connected to the outlet of the warning light.

In U.S. Pat. No. 1,541,798 of Charles W. Denny et al, a radio phone plug is shown having a plug-in connector for use in connection with a radio device.

Duncan T. S. MacLennan, in U.S. Pat. No. 2,030,011, shows an electrically operated cigarette lighter having a plurality of lighting buckets having suitable shapes for accepting different type cigarettes.

Theodore Oshinsky, in U.S. Pat. No. 2,508,770, shows a renewable fuse tap receptacle which serves as an intermediate receptacle for accepting a conventional appliance plug.

In U.S. Pat. No. 2,620,388 of Earl E. Franz, a combination warning signal and trouble lamp is shown having a flexible cord provided at its distal end with a conventional connector plug adapted to be inserted into the socket of the cigarette lighter. The trouble lamp includes a manually operable switch for controlling the operation thereof.

Raymond B. Paulson, in U.S. Pat. No. 2,702,893, shows an electrical plug receptacle having a plurality of outlet portions adapted to receive a corresponding plurality of connector plugs.

Leonard M. Tesmer shows, in U.S. Pat. No. 3,099,507, a three-way double light adapter having a common connector and a pair of sockets for accepting a pair of light bulbs for parallel operation.

In U.S. Pat. No. 3,137,448 of William H. Holzhause, an adapter for an automobile tail light is shown which supplies electrical power to the tail light of a trailer towed by the automobile and which is adapted to be connected to the tail light circuits of the trailer and automobile for effecting simultaneous ignition of the tail lights in both circuits.

In U.S. Pat. No. 3,535,638, Nilo A. Michelin shows an electrical unit for use in testing or repairing television receiver sets having a plurality of plug-in devices.

SUMMARY OF THE INVENTION

The present invention comprehends an improved duplex outlet device which is adapted to be used with the cirgarette lighter means of an automotive vehicle and which provides a first socket for accommodating the cigarette lighter of the vehicle and a second socket for accommodating a connector plug of an auxiliary device.

In the illustrated embodiment, the auxiliary device comprises a CB radio.

The duplex outlet device may further include manually operable means for effecting a positive interlocked association of the device with the vehicle cigarette lighter socket.

The device may further include fuse means for limiting the current to the auxiliary device.

The outlet device may further include manually operable switch means for controlling the current to the auxiliary device.

The outlet device may further be provided with antenna connecting means.

In the illustrated embodiment, the antenna-connecting means is carried by an auxiliary housing which is removably connected to the housing means of the outlet device for selective use as desired.

The antenna-connecting means may comprise a quick-connect device.

In the illustrated embodiment, the plug and sockets of the outlet device comprise cylindrical means extending axially parallel to each other and in the illustrated device, the axes of the sockets are offset equally from the axis of the plug portion of the device.

The duplex outlet device of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
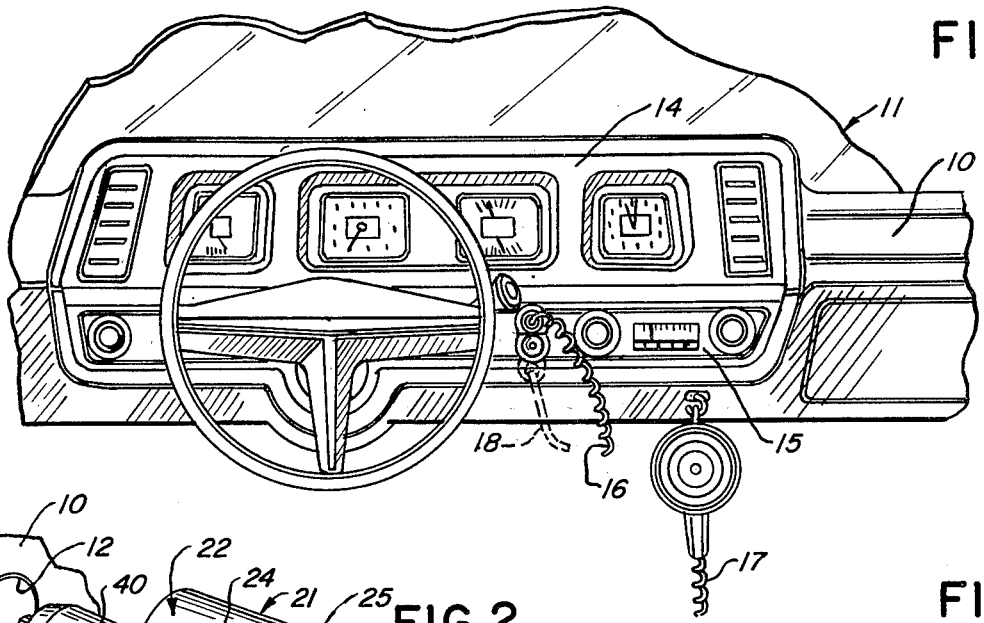
FIG. 1 is a fragmentary elevation of the dashboard portion of a vehicle provided with a duplex outlet device embodying the invention.

In the exemplary embodiment of the invention as disclosed in the drawing, the dashboard 10 of a conventional automotive vehicle 11 is provided with a conventional cigarette lighter device having a socket portion 12 received in the dashboard 10, and a removable lighting plug 13 adapted to be removably received in the socket 12. As shown in FIG. 1 of the drawing, the dashboard may be provided with the usual instruments 14. The vehicle may be provided with an auxiliary device, such as a CB radio 15, which may also be mounted in the dashboard 10, as desired.

The present invention is concerned with the provision of improved means for providing power to auxiliary devices, such as the CB radio 15, from the cigarette lighter socket 12. In the present invention, the auxiliary device may include a power cord 16, a microphone cable 17, and an antenna cable 18. Power cord 16 may be provided at its distal end with a plug connector 19. Antenna cable 18 may be provided at its distal end with a quickconnect connector portion 20.

Figure 2:
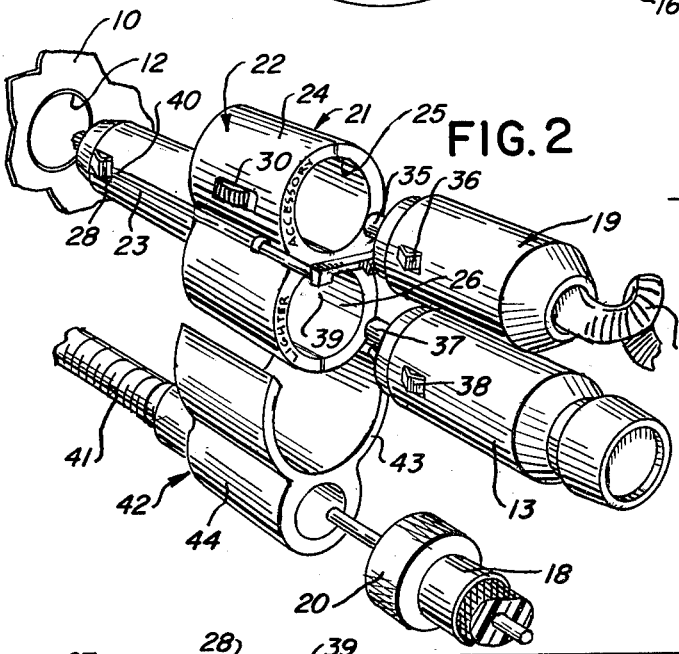
FIG. 2 is a fragmentary enlarged perspective view of the outlet device.
Figure 3:
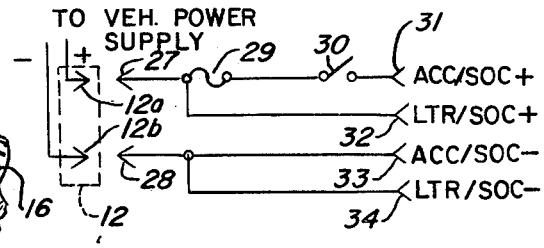
FIG. 3 is a schematic wiring diagram of the electrical circuitry of the outlet device.
Figure 4:
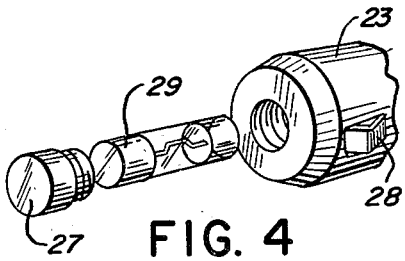
FIG. 4 is a fragmentary exploded view of the fuse portion of the outlet device.

As indicated briefly above, the present invention comprehends an improved duplex outlet device generally desiganted 21 which is adapted to provide power to the auxiliary device 15 as well as to the cigarette lighter plug portion 13 from the vehicle cigarette lighter socket portion 12. More specifically, as illustrated in FIG. 2, the outlet device 21 includes a housing portion 22 defining an inner plug portion 23 arranged to be removably received in the vehicle socket 12, and an outer portion 24 defining a pair of juxtaposed outwardly opening sockets 25 and 26. As shown in FIG. 3, the socket 12 includes a pair of contacts **12*a* and 12*b* connected to the vehicle power supply for providing electrical power to the lighter plug 13 in normal use. Plug portion 23 of the outlet device 21 includes a pair of contacts 27 and 28 adapted to be in electrical conductive association with the contacts 12*a* and 12*b* of the socket 12 when the plug portion 23 is inserted into the socket 12**.

The positive terminal 27 of the plug portion 23 may comprise an end cap for receiving a conventional fuse 29 within the plug portion 23. As shown in FIG. 3, the fuse 29 is connected through a manually operable switch 30 to a first contact 31 within the socket 25. As further shown in FIG. 3, contact 27 of plug 23 is connected directly to a second contact 32 within the socket 26.

As further shown in FIG. 3, contact 28 is directly connected to a contact 33 within socket 25 and a contact 34 within socket 26.

Contacts 31 and 32 in socket 25 are adapted to be engaged by contacts 35 and 36 of auxiliary device plug 19. Contacts 33 and 34 are adapted to be engaged by the contacts 37 and 38 of the cigarette lighter plug 13. Thus, when plug 19 is inserted into socket 25 with the device plug portion 23 inserted into socket 12, electrical power to the auxiliary device 15 is provided from the vehicle power supply through the fuse 29 and switch 30. When the cigarette lighter plug 13 is inserted into socket 26 with the device plug portion 23 received in socket 12, electrical power is provided to the cigarette lighter plug 13 from the vehicle power supply.

Figure 6:
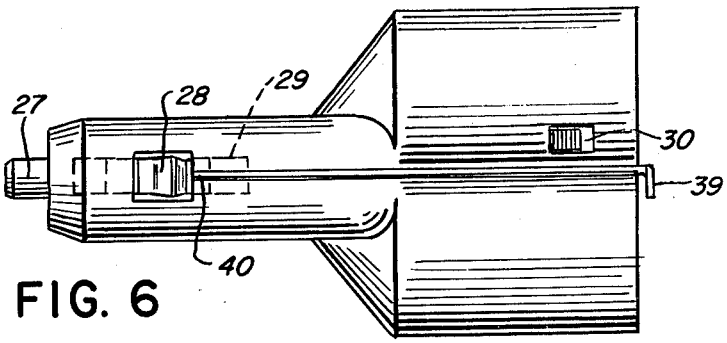
FIG. 6 is a top plan view thereof.

As shown in FIG. 2, each of plug portion 23 and sockets 25 and 26 of the housing 22 comprises cylindrical housing portions. As shown in FIG. 2, the axes of the sockets 25 and 26 extend parallel to the axis of the plug portion 23 and are spaced equally oppositely from the plug portion axis to provide a symmetrical arrangement of the sockets as seen in each of FIGS. 2, 6 and 7.

To provide a positive retention of the device 21 in the dashboard socket 12, a manually operable interlock rod 39 may be provided slidably carried by the housing 22 and having an end portion 40 adapted to maintain the contact 28 in outer urged disposition to have positive interlocked association with the contact **12*b* of the lighter socket 12. When it is desired to remove the outlet device 21 from the dashboard socket 12, the user need merely withdraw the control rod 39, permitting the contact 28 to resiliently disengage from the contact 12*b* and thereby permit facilitated withdrawal of the plug 23 from the socket 12**.

Figure 5:
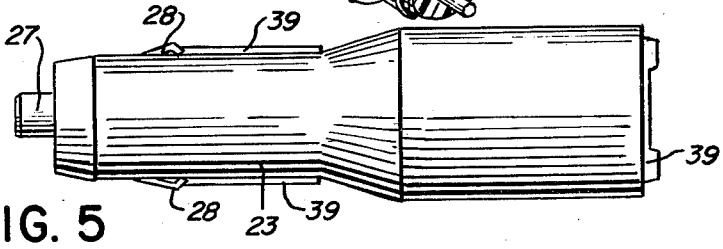
FIG. 5 is a side elevation of the outlet device.
Figure 7:
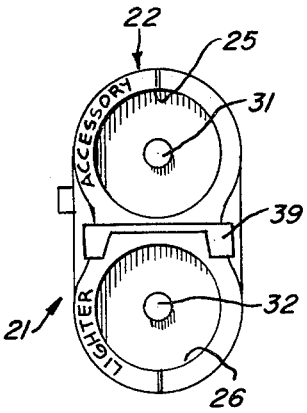
FIG. 7 is an end elevation thereof.

As best seen in FIGS. 5 and 7, the locking lever 39 may be bifurcated so as to engage both terminals 28 at diametrically opposite sides of the plug portion 23, thereby providing further positive improved retention of the plug portion 23 within the socket 12 when desired.

As further indicated briefly above, the outlet device 21 may further include means for quick-connecting the antenna connector 20 to an antenna lead 41. More specifically as shown in FIG. 2, an auxiliary housing portion 42 may be provided with a clip portion 43 adapted to engage the housing 22 about the socket 26. The auxiliary housing portion 42 may include a quickconnect female connector 40 adapted to receive the male connector 20 of the antenna cable 18 to permit a quick-connect or disconnect of the CB radio antenna from the antenna lead 41 as desired.

As will be obvious to those skilled in the art, the auxiliary socket 25 may be utilized to provide power to any desired auxiliary device, the CB radio 15 being illustrated herein as exemplary only. Similarly, if it is desired to utilize a second auxiliary device in lieu of the cigarette lighter plug 13, the socket 26 may be utilized in combination with a second plug 19 and power cord 16, as desired. As indicated above, the antenna connector may be selectively utilized in combination with the device 22 further as desired.

Thus, the duplex outlet device of the present invention provides a low cost, highly flexible adapter for use in providing auxiliary power in an automotive vehicle from a conventional cigarette lighter socket thereof. While the outlet device is extremely simple and economical of construction, it provides for facilitated use as desired by the vehicle operator.

The foregoing disclosure of specific embodiments is illustrative of the broad inventive concepts comprehended by the invention.

I claim:

1. In an automotive vehicle having a cigarette lighter means defined by a cup-shaped first socket having an outer open end, and spaced electrical power terminals exposed within the shell, an improved duplex outlet device comprising:

housing means defining an inner plug portion arranged to be removably received in said socket, and an outer portion defining a pair of juxtaposed outwardly opening second and third sockets;

means for releasably locking said plug portion within said first socket;

electrical connection means having first contacts carried by said plug portion for engaging said power terminals as an incident of the plug portion being disposed within said first socket, second contacts exposed within said second socket for electrical connection to an auxiliary plug inserted into said second socket, third contacts exposed within said third socket for electrical connection to a cigarette lighter plug portion inserted into said third socket, and conductor means for electrically connecting said first contacts to said second and third contacts;

fuse means carried by said outlet device for limiting current flow through said conductor means to said second contacts; and switch means carried by said outlet device for selectively controlling delivery of current through said conductor means to said second contacts, said housing plug portion and second and third sockets being cylindrical and disposed in axially parallel relationship.

2. The automotive vehicle outlet device of claim 1 wherein said switch means includes a manually operable element carried by said housing means.

3. The automotive vehicle outlet device of claim 1 wherein said means for releasably locking said plug portion within said first socket comprises manually operable means for selectively providing a positive interlock between said outlet device and said lighter means first socket.

4. The automotive vehicle outlet device of claim 1 wherein the axes of said second and third sockets are spaced oppositely from the plug axis.

5. The automotive vehicle outlet device of claim 1 wherein said current limiting means comprises a replaceable fuse carried by said plug portion of the housing means and said switch means comprises a manually operable switch carried by said outer portion of the housing means.

6. The automotive vehicle outlet device of claim 1 further including an auxiliary housing, means for releasably mounting the auxiliary housing to said outer portion of the housing means, and an electrically conductive connector carried by said auxiliary housing.

7. In an automotive vehicle having a cigarette lighter means defined by a cup-shaped first socket having an outer open end, and spaced electrical power terminals exposed within the shell, an improved duplex outlet device comprising:

housing means defining an inner plug portion arranged to be removably received in said socket, and an outer portion defining a pair of juxtaposed outwardly opening second and third sockets;

means for releasably locking said plug portion within said first socket;

electrical connection means having first contacts carried by said plug portion for engaging said power terminals as an incident of the plug portion being disposed within said first socket, second contacts exposed within said second socket for electrical connection to an auxiliary plug inserted into said second socket, third contacts exposed within said third socket for electrical connection to a cigarette lighter plug portion inserted into said third socket, and conductor means for electrically connecting said first contacts to said second and third contacts;

fuse means carried by said outlet device for limiting current flow through said conductor means to said second contacts;

switch means carried by said outlet device for selectively controlling delivery of current through said conductor means to said second contacts; and antenna connecting means carried by said housing means.

8. In an automotive vehicle having a cigarette lighter means defined by a cup-shaped first socket having an outer open end, and spaced electrical power terminals exposed within the shell, an improved duplex outlet device comprising:

housing means defining an inner plug portion arranged to be removably received in said socket, and an outer portion defining a pair of juxtaposed outwardly opening second and third sockets;

means for releasably locking said plug portion within said first socket;

electrical connection means having first contacts carried by said plug portion for engaging said power terminals as an incident of the plug portion being disposed within said first socket, second contacts exposed within said second socket for electrical connection to an auxiliary plug inserted into said second socket, third contacts exposed within said third socket for electrical connection to a cigarette lighter plug portion inserted into said third socket, and conductor means for electrically connecting said first contacts to said second and third contacts;

fuse means carried by said outlet device for limiting current flow through said conductor means to said second contacts;

switch means carried by said outlet device for selectively controlling delivery of current through said conductor means to said second contacts; and an auxiliary housing portion carried by said device and having a quick-connect antenna connector.

9. In an automotive vehicle having a cigarette lighter means defined by a cup-shaped first socket having an outer open end, and spaced electrical power terminals exposed within the shell, an improved duplex outlet device comprising:

housing means defining an inner plug portion arranged to be removably received in said socket, and an outer portion defining a pair of juxtaposed outwardly opening second and third sockets;

means for releasably locking said plug portion within said first socket;

electrical connection means having first contacts carried by said plug portion for engaging said power terminals as an incident of the plug portion being disposed within said first socket, second contacts exposed within said second socket for electrical connection to an auxiliary plug inserted into said second socket, third contacts exposed within said third socket for electrical connection to a cigarette lighter plug portion inserted into said third socket, and conductor means for electrically connecting said first contacts to said second and third contacts;

fuse means carried by said outlet device for limiting current flow through said conductor means to said second contacts;

switch means carried by said outlet device for selectively controlling delivery of current through said conductor means to said second contacts;

an auxiliary housing;

means for releasably mounting the auxiliary housing to said outer portion of the housing means; and a quick-connect antenna connector carried by said auxiliary housing.

* * * * *